US011421857B2

(12) United States Patent
Apodaca et al.

(10) Patent No.: US 11,421,857 B2
(45) Date of Patent: Aug. 23, 2022

(54) METHODS FOR DECORATING A TRANSLUCENT CONTAINER

(71) Applicant: One Offs Plus, LLC, Northglenn, CO (US)

(72) Inventors: Ace Apodaca, Northglenn, CO (US); Anthony Apodaca, Northglenn, CO (US); Cameron Apodaca, Northglenn, CO (US)

(73) Assignee: One Offs Plus, LLC, Northglenn, CO (US)

( * ) Notice: Subject to any disclaimer, the term of this patent is extended or adjusted under 35 U.S.C. 154(b) by 0 days.

(21) Appl. No.: 17/213,022

(22) Filed: Mar. 25, 2021

(65) Prior Publication Data

US 2021/0302008 A1 Sep. 30, 2021

Related U.S. Application Data

(60) Provisional application No. 63/002,838, filed on Mar. 31, 2020.

(51) Int. Cl.

| | |
|---|---|
| ***B05D 5/06*** | (2006.01) |
| ***B44C 3/00*** | (2006.01) |
| ***B05D 3/06*** | (2006.01) |
| ***B44C 1/22*** | (2006.01) |
| ***B05D 7/00*** | (2006.01) |
| ***F21V 11/08*** | (2006.01) |
| ***F21V 9/08*** | (2018.01) |
| ***B44F 1/06*** | (2006.01) |
| ***B65D 23/08*** | (2006.01) |
| *F21W 121/00* | (2006.01) |
| *B65D 51/24* | (2006.01) |

(52) U.S. Cl.

CPC ..... *F21V 11/08* (2013.01); *B05D 3/06* (2013.01); *B05D 5/063* (2013.01); *B05D 5/065* (2013.01); *B44C 1/228* (2013.01); *B44C 3/005* (2013.01); *B44F 1/06* (2013.01); *B65D 23/0807* (2013.01); *F21V 9/08* (2013.01); *B05D 7/53* (2013.01); *B05D 2201/00* (2013.01); *B05D 2203/35* (2013.01); *B05D 2350/65* (2013.01); *B65D 51/248* (2013.01); *F21W 2121/00* (2013.01)

(58) Field of Classification Search

CPC ..... B44C 1/227; B44C 1/228; B44C 3/005; B44F 1/06; B05D 3/06; B05D 3/063; B05D 7/53; B05D 2350/65

USPC ..... 427/554, 555

See application file for complete search history.

(56) References Cited

U.S. PATENT DOCUMENTS

| | | | | |
|---|---|---|---|---|
| 3,770,936 A * | 11/1973 | Rively | B23K 26/0823 | 219/121.81 |
| 6,639,178 B2 * | 10/2003 | Kupisiewicz | B23K 26/361 | 219/121.69 |
| 2001/0054564 A1 * | 12/2001 | Bethune | B65D 51/245 | 215/230 |

* cited by examiner

*Primary Examiner* — Michael P Wieczorek
(74) *Attorney, Agent, or Firm* — Perkins Coie LLP

(57) ABSTRACT

A method for decorating a translucent container including cleaning an exterior surface of the container and applying a silver layer to the exterior surface followed by a black layer applied over the silver layer. Portions of the silver and black layers are selectively removed to form one or more shapes using a laser. A translucent protective layer is applied over the entire exterior of the container.

13 Claims, 4 Drawing Sheets

METHODS FOR DECORATING A TRANSLUCENT CONTAINER

CROSS-REFERENCE TO RELATED APPLICATION

This application claims the benefit of and priority to U.S. Provisional Patent Application No. 63/002,838, filed Mar. 31, 2020, the disclosure of which is incorporated herein by reference in its entirety.

TECHNICAL FIELD

This patent application is directed to containers used as decorations, and more specifically, to methods for decorating translucent items such as containers.

BACKGROUND

Containers such as bottles and vases have long been used as decorations as well as vessels for storing and carrying liquids, for example. Traditionally, these containers are marked with labels or silk screen in order to indicate the contents of the container and/or add decoration.

BRIEF DESCRIPTION OF THE DRAWINGS

The methods and decorative containers described herein may be better understood by referring to the following Detailed Description in conjunction with the accompanying drawings, in which like reference numerals indicate identical or functionally similar elements.

Figure 1:
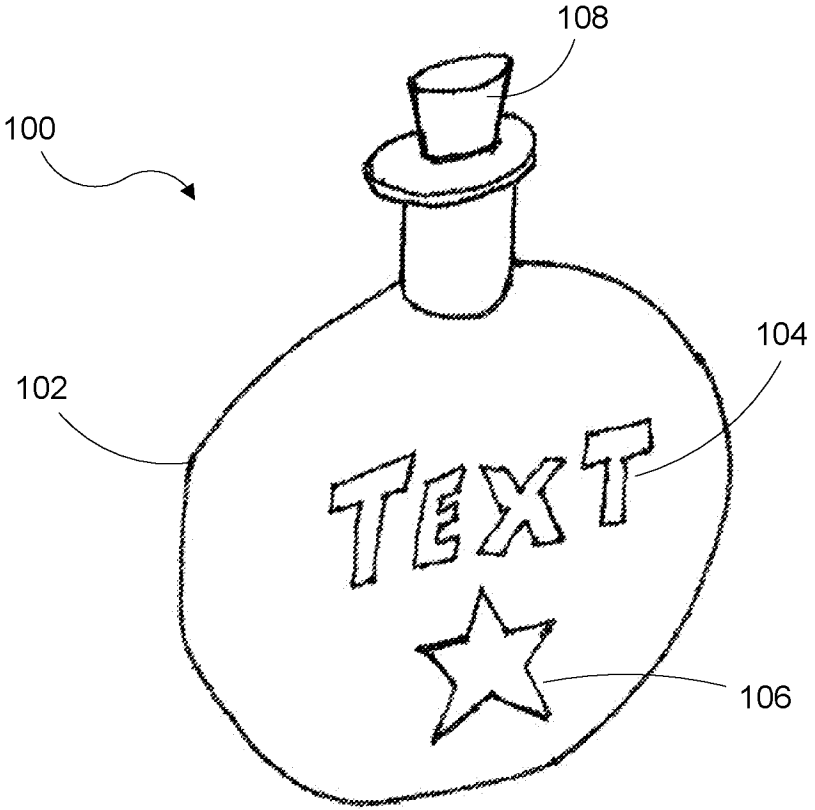
FIG. 1 is a perspective view of a container decorated in accordance with embodiments of the disclosed technology.

The headings provided herein are for convenience only and do not necessarily affect the scope of the embodiments. Further, the drawings have not necessarily been drawn to scale. For example, the dimensions of some of the elements in the figures may be expanded or reduced to help improve the understanding of the embodiments. Moreover, while the disclosed technology is amenable to various modifications and alternative forms, specific embodiments have been shown by way of example in the drawings and are described in detail below. The intention, however, is not to unnecessarily limit the embodiments described. On the contrary, the embodiments are intended to cover all suitable modifications, combinations, equivalents, and alternatives falling within the scope of this disclosure.

SUMMARY

The disclosed technology includes methods for decorating a translucent container. In some embodiments, a method can include cleaning an exterior surface of a container, applying a silver layer to the exterior surface, and applying a black layer over the silver layer. Portions of the silver and black layers can be selectively removed to form one or more shapes. In some embodiments, a translucent protective layer can be applied over the entire container. In some embodiments, the method can further include applying a color layer over the black layer subsequent to applying the black layer. In some embodiments, removing portions of the silver and black layers is performed with a laser. In some embodiments, the method can further include positioning an illumination device inside the container. In some embodiments, the laser is directed to remove the portions of the silver and black layers by a graphics file representing a hand written message.

The disclosed technology includes decorations comprising a translucent container having an interior region and an exterior surface with a silver layer on the exterior surface and a black layer on top of the silver layer. One or more shapes are formed in the silver and black layers and a translucent protective layer covers the container. In some embodiments, an illumination device is positioned in the interior region. In some embodiments, the decoration further comprises a color layer disposed between the black layer and the translucent protective layer. In other embodiments, the illumination device comprises a removable lighted cork. In further embodiments, the translucent container comprises glass.

In another embodiment according to the disclosed technology, a method for decorating a translucent container can include cleaning an exterior surface of the container, applying a reflective layer to the exterior surface, and applying an opaque layer over the reflective layer. Portions of the reflective and opaque layers can be selectively removed to form one or more shapes. In some embodiments, a translucent protective layer can be applied over the entire container. In some embodiments, the reflective layer comprises silver paint. In some embodiments, the opaque layer comprises black paint. In some embodiments, the method further comprises applying a color layer over the black paint subsequent to applying the black paint. In some embodiments, removing portions of the reflective and opaque layers is performed with a laser. In some embodiments, the laser is directed to remove the portions of the reflective and opaque layers by a graphics file representing a hand written message. In some embodiments, the method further comprises positioning an illumination device inside the container. In some embodiments, the opaque layer comprises paint having a color other than black.

DETAILED DESCRIPTION

Various examples of the methods and articles introduced above will now be described in further detail. The following description provides specific details for a thorough understanding and enabling description of these examples. One skilled in the relevant art will understand, however, that the techniques and technology discussed herein may be practiced without many of these details. Likewise, one skilled in the relevant art will also understand that the technology can include many other features not described in detail herein. Additionally, some well-known structures or functions may not be shown or described in detail below so as to avoid unnecessarily obscuring the relevant description.

The terminology used below is to be interpreted in its broadest reasonable manner, even though it is being used in conjunction with a detailed description of some specific examples of the embodiments. Indeed, some terms may even be emphasized below; however, any terminology intended to be interpreted in any restricted manner will be overtly and specifically defined as such in this section.

FIG. 1 illustrates a decoration 100 according to embodiments of the disclosed technology. The decoration 100 can include a translucent container 102, such as a glass bottle, covered in an opaque layer or layers of coatings, such as paint. These layer(s) can be selectively removed, using a laser for example, from the surface of the container 102 to form one or more shapes. Representative shapes can include letters 104 forming text and symbols, such as star 106. The layer(s) can also be removed to form numbers, indicia, graphics, pictures, and any other markings and/or artwork typical of laser engraving, for example.

In some embodiments, a smart pen can be used to digitally create (in .pdf format) custom hand written messages, sketches, and signatures, to name a few. Typical laser engraving systems can use .pdf, .jpg, and most graphics formats (e.g., graphics files) to guide the laser. Thus, the layer(s) can be selectively removed by the laser according to any of these formats. The Neo Smartpen available from Neolab USA of Los Angeles, Calif. is a suitable smart pen to create laser engraving file formats.

In some embodiments, the decoration 100 can include a lighted cork 108 which provides illumination inside the container 102. As explained more fully below with respect to FIG. 3, the lighted cork 108 projects light outwardly through the removed portions such as text 104 and star 106 to enhance the appearance of the decoration 100.

Figure 2C:
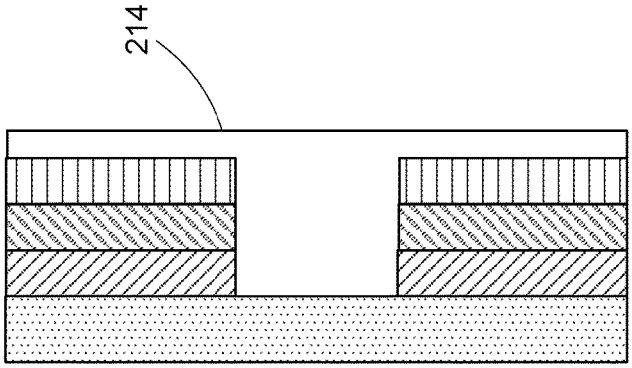
FIG. 2C is a partial side view in cross-section of a container wall illustrating representative steps of the disclosed methods according to embodiments of the disclosed technology.
Figure 2B:
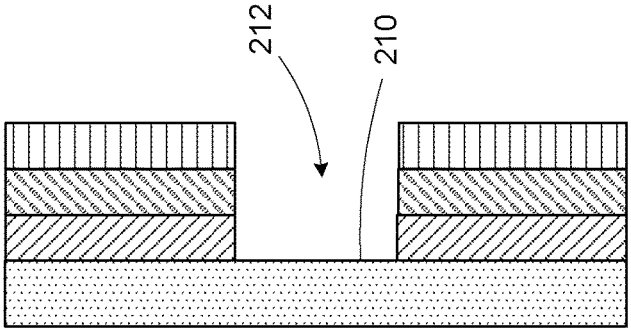
FIG. 2B is a partial side view in cross-section of a container wall illustrating representative steps of the disclosed methods according to embodiments of the disclosed technology.
Figure 2A:
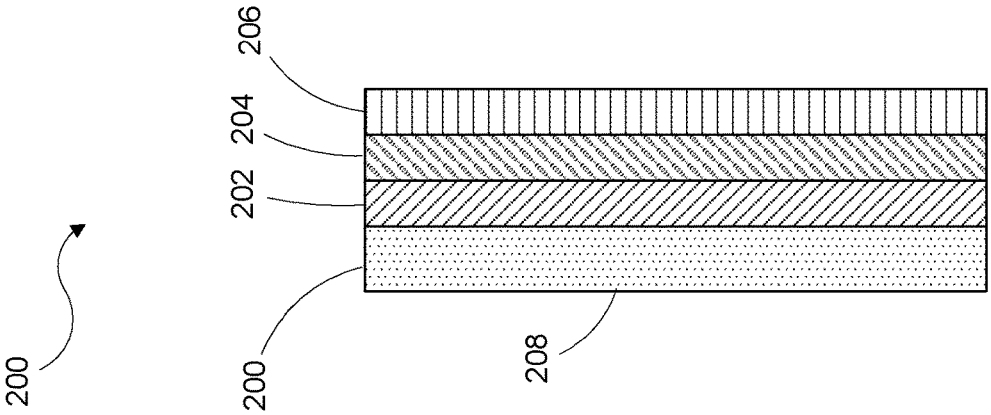
FIG. 2A is a partial side view in cross-section of a container wall illustrating representative steps of the disclosed methods according to embodiments of the disclosed technology.

FIGS. 2A-2C illustrate various stages of creating the above mentioned layer(s) and the portions removed from those layers, according to embodiments of the disclosed technology. As shown in FIG. 2A, a container wall 200 has an interior surface 208 (defining an interior region) and an exterior surface 210 (FIG. 2B). A first, reflective layer 202 is applied to the exterior surface 210. The reflective layer 202 can be a layer of silver paint, for example. In some embodiments, the reflective layer 202 can comprise metallic silver or white paint. In some cases, the reflective layer 202 might not be completely opaque and a second, opaque layer 204 can be applied to the reflective layer 202 to help prevent light from escaping through the layers. In some embodiments, the opaque layer 204 can be a layer of black paint, for example. In some embodiments, a third, color layer 206 can be applied to the opaque layer 204. In some embodiments, the opaque layer 204 and the color layer 206 can comprise the same paint color. In other words, in some embodiments, the opaque layer 204 does not have to be black. Paint or other material can be applied by spraying or dipping. The layers can comprise e.g., paint, foil, film, plastic, or other suitable coating or covering material, for example.

With reference to FIG. 2B, portions 212 of the layers 202, 204, and 206 can be selectively removed in order to create the desired text and symbols, for example. In some embodiments, the layers can be removed by burning with a laser to expose the exterior surface 210 of the container 200. An infrared 1064 nm wavelength laser has been found to be suitable for removing the layers according to the disclosed technology. Once the layers have been removed from the exterior surface 210, a clear coat layer 214 can be applied to the resulting layers and removed portions 212 as shown in FIG. 2C. The clear coat layer 214 can help protect the layers 202, 204, and 206 from chipping and scratches. In some embodiments, the clear coat layer 214 is transparent or at least translucent.

Figure 3:
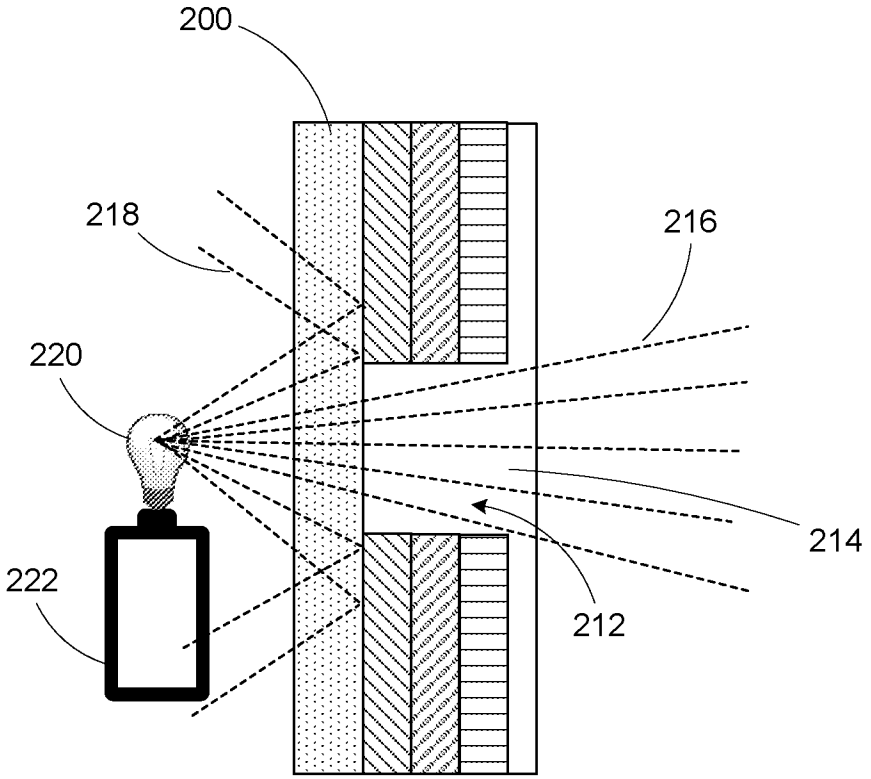
FIG. 3 is a partial side view in cross-section of a container including an illumination device.

As shown in FIG. 3 an illumination device (e.g., lighted cork 108, FIG. 1) comprising an LED 220 and battery 222, for example, can be positioned on the interior of the container 200. The LED 220 projects light 216 outwardly through the container wall and removed portions 212. In other areas where the layers remain, the light reflects 218 inside the container. Changing the color of LED 220 can change the appearance of the light 216 projecting through the portions 212.

It should be understood that although the embodiments have been described with respect to containers e.g., glass bottles, the technology can be applied to other translucent or transparent articles, such as for example and without limitation, windows, mugs, pitchers, and glass ornaments. In some embodiments, other materials besides glass such as plastic can be used. Also, the container does not necessarily have to be clear and can be any suitable color including green or amber, for example.

Figure 4:
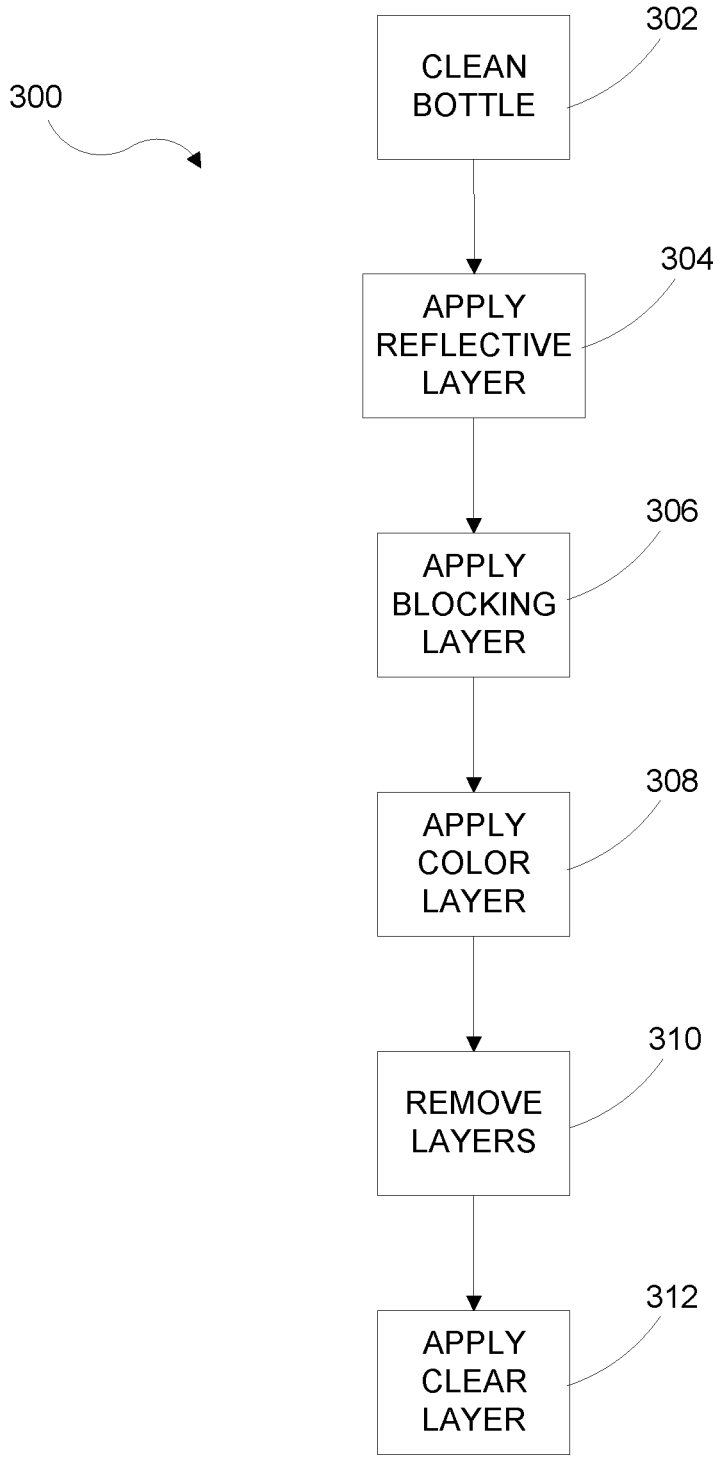
FIG. 4 is a flow diagram illustrating a method for decorating a container according to embodiments of the disclosed technology.

FIG. 4 is a flow diagram illustrating a method 300 for decorating a container according to embodiments of the disclosed technology. At step 302 the container to be decorated, e.g., a glass bottle, can be cleaned with alcohol for example to help ensure that the layers adhere to the exterior surface. At step 304, a reflective layer (e.g., silver) is applied to the exterior surface. A blocking or opaque layer is applied to the reflective layer at step 306. In some embodiments, a color layer can be applied to the blocking layer at step 308. For example, a red or blue layer can be applied as appropriate for the theme of the decoration. In some embodiments, multiple colors can be applied to the exterior covering different portions of the container. At step 310, the layers are selectively removed to create the desired pictures, patterns, text, symbols, and/or shapes, for example. At step 312, a clear coating or layer can be applied to protect the painted layers of the decoration.

As presented in this application, "transparent" has the meaning of allowing the specular transmission of light allowing light to pass through so that objects behind can be distinctly seen with minimal distortion. And, "translucent" means that the material, or layers of material, allows light, but not necessarily detailed images, to pass through; also known as semi-transparent. Any references to translucent are meant to apply to either transparent or semi-transparent embodiments. "Opaque" has the meaning of appearing to block all light from passing through the material or layers of material. "Opacity" refers to the degree to which a material or paint is opaque. In other words, opacity refers to a material's transmittance or ability to pass light therethrough.

Remarks

The above description and drawings are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. It will be appreciated that the same thing can be said in more than one way. Consequently, alternative language and synonyms may be used for any one or more of the terms discussed herein, and any special significance is not to be placed upon whether or not a term is elaborated or discussed herein. Synonyms for some terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the disclosure is not limited to various embodiments given in this specification. Unless otherwise defined, all technical and scientific terms used herein have the same meaning as commonly understood by one of ordinary skill in the art to which this disclosure pertains. In the case of conflict, the present document, including definitions, will control.

What is claimed is:

1. A method for decorating a translucent container, the method comprising:

cleaning an exterior surface of the container;

applying a silver layer to the exterior surface;

applying a black layer over the silver layer;

selectively removing portions of the silver and black layers to form one or more shapes; and applying a translucent protective layer over the container.

2. The method of claim 1, further comprising applying a color layer over the black layer subsequent to applying the black layer.

3. The method of claim 1, wherein removing portions of the silver and black layers is performed with a laser.

4. The method of claim 3, wherein the laser is directed to remove the portions of the silver and black layers by a graphics file representing a hand written message.

5. The method of claim 1, further comprising positioning an illumination device inside the container.

6. A method for decorating a translucent container, the method comprising:

cleaning an exterior surface of the container;

applying a reflective layer to the exterior surface;

applying an opaque layer over the reflective layer;

selectively removing portions of the reflective and opaque layers to form one or more shapes; and applying a translucent protective layer over the container.

7. The method of claim 6, wherein the reflective layer comprises silver paint.

8. The method of claim 6, wherein the opaque layer comprises black paint.

9. The method of claim 8, further comprising applying a color layer over the black paint subsequent to applying the black paint.

10. The method of claim 6, wherein removing portions of the reflective and opaque layers is performed with a laser.

11. The method of claim 10, wherein the laser is directed to remove the portions of the reflective and opaque layers by a graphics file representing a hand written message.

12. The method of claim 6, further comprising positioning an illumination device inside the container.

13. The method of claim 6, wherein the opaque layer comprises paint having a color other than black.

* * * * *